US010870134B2

(12) United States Patent
Omori et al.

(10) Patent No.: US 10,870,134 B2
(45) Date of Patent: Dec. 22, 2020

(54) PEELING DEVICE AND IMAGE FORMING APPARATUS

(71) Applicant: FUJI XEROX CO., LTD., Tokyo (JP)

(72) Inventors: Yuichi Omori, Kanagawa (JP); Noriaki Kojima, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 16/519,317

(22) Filed: Jul. 23, 2019

(65) Prior Publication Data

US 2020/0298282 A1 Sep. 24, 2020

(30) Foreign Application Priority Data

Mar. 22, 2019 (JP) ..... 2019-054411

(51) Int. Cl.

*G03G 15/16* (2006.01)
*B08B 1/02* (2006.01)
*G03G 21/10* (2006.01)

(52) U.S. Cl.

CPC ..... *B08B 1/02* (2013.01); *G03G 15/16* (2013.01); *G03G 21/10* (2013.01); *G03G 2215/1647* (2013.01); *G03G 2221/1627* (2013.01)

(58) Field of Classification Search

CPC .... G03G 15/16; G03G 15/6532; G03G 21/10; G03G 2215/1647; G03G 2215/00573; G03G 2221/1627; B08B 1/02

See application file for complete search history.

(56) References Cited

U.S. PATENT DOCUMENTS 4,261,560 A * 4/1981 Yanagawa ..... G03G 15/6532 271/308
4,417,800 A * 11/1983 Hirose ..... G03G 15/6532 271/312
4,806,985 A * 2/1989 Foley ..... G03G 15/6532 271/311
5,006,905 A * 4/1991 Satoh ..... G03G 15/6532 271/312
5,621,513 A * 4/1997 Pitts ..... G03G 15/6532 399/398
7,702,277 B2 * 4/2010 Yamauchi ..... G03G 15/657 399/16
10,345,746 B1 * 7/2019 Cahill ..... G03G 15/2028

(Continued)

FOREIGN PATENT DOCUMENTS

JP 06222681 A * 8/1994
JP 2008-158137 A 7/2008

OTHER PUBLICATIONS

Machine translation of JP06222681 (Year: 1994).*

*Primary Examiner* — David J Bolduc
(74) *Attorney, Agent, or Firm* — Sughrue Mion, PLLC

(57) ABSTRACT

A peeling device includes a peeling member and a cover member. The peeling member peels a recording medium, to which an unfixed developer has been transferred from an image holding member, from the image holding member. The leading end of the peeling member contacts the image holding member. The cover member covers a surface of the peeling member with a gap interposed between the peeling member and the cover member. The surface of the peeling member includes at least the leading end of the peeling member, and includes at least a surface of the peeling member on the side opposite to the image holding member.

9 Claims, 15 Drawing Sheets

(56) References Cited

U.S. PATENT DOCUMENTS 10,423,099 B1* 9/2019 Cahill ..... G03G 15/2028
2004/0084838 A1* 5/2004 Murakami ..... G03G 15/6532 271/307
2006/0001723 A1* 1/2006 Gordon ..... G03G 15/6532 347/104
2006/0092258 A1* 5/2006 Taira ..... G03G 15/6573 347/156
2006/0115304 A1* 6/2006 Ahn ..... G03G 15/6532 399/303
2006/0182478 A1* 8/2006 Miller ..... G03G 15/6532 399/398
2006/0198668 A1* 9/2006 Tsujita ..... G03G 15/6532 399/315
2007/0048036 A1* 3/2007 Kanematsu ..... G03G 15/2028 399/323
2009/0190981 A1* 7/2009 Tanaka ..... G03G 15/657 399/397
2009/0269114 A1* 10/2009 Yuge ..... G03G 15/657 399/399
2011/0188905 A1* 8/2011 Shinkawa ..... G03G 15/20 399/323
2011/0221842 A1* 9/2011 Castillo ..... B41J 13/24 347/104
2012/0034008 A1* 2/2012 Takiguchi ..... G03G 15/657 399/397
2012/0051826 A1* 3/2012 Barton ..... B65H 29/56 400/644
2012/0257916 A1* 10/2012 Yamauchi ..... G03G 15/6532 399/398
2013/0105091 A1* 5/2013 Yamauchi ..... B32B 43/006 156/761
2013/0259555 A1* 10/2013 Haruyama ..... G03G 15/6576 399/406
2015/0108708 A1* 4/2015 Fujii ..... B65H 3/32 271/19
2015/0248099 A1* 9/2015 Sakashita ..... G03G 15/75 399/101
2018/0273320 A1* 9/2018 Hattori ..... B65H 5/068
2018/0299809 A1* 10/2018 Saitoh ..... G03G 15/6532
2018/0373192 A1* 12/2018 Hirose ..... G03G 15/6532

* cited by examiner

PEELING DEVICE AND IMAGE FORMING APPARATUS

CROSS-REFERENCE TO RELATED APPLICATIONS

This application is based on and claims priority under 35 USC 119 from Japanese Patent Application No. 2019-054411 filed Mar. 22, 2019.

BACKGROUND

(i) Technical Field

The present disclosure relates to a peeling device and an image forming apparatus.

(ii) Related Art

Japanese Unexamined Patent Application Publication No. 2008-158137 discloses an image forming apparatus that includes a peeling unit that peels a recording medium from a surface of a photosensitive drum to guide the recording medium in a transport direction. The peeling unit includes a peeling lug that contacts the photosensitive drum, and auxiliary lugs that are disposed on both sides of the peeling lug and that do not contact the photosensitive drum. The auxiliary lugs guide transport of the recording medium, which has been peeled by the peeling lug, such that the recording medium does not contact the back portion of the peeling lug.

SUMMARY

Aspects of non-limiting embodiments of the present disclosure relate to providing a peeling device and an image forming apparatus that suppress scattering of a toner cloud generated from a peeling member that peels a recording medium, to which a toner has been transferred, from an image holding member.

Aspects of certain non-limiting embodiments of the present disclosure overcome the above disadvantages and/or other disadvantages not described above. However, aspects of the non-limiting embodiments are not required to overcome the disadvantages described above, and aspects of the non-limiting embodiments of the present disclosure may not overcome any of the disadvantages described above.

According to an aspect of the present disclosure, there is provided a peeling device including: a peeling member that peels a recording medium, to which an unfixed developer has been transferred from an image holding member, from the image holding member, a leading end of the peeling member contacting the image holding member; and a cover member that covers a surface of the peeling member with a gap interposed between the peeling member and the cover member, the surface of the peeling member including at least the leading end of the peeling member and including at least a surface of the peeling member on a side not facing the image holding member.

BRIEF DESCRIPTION OF THE DRAWINGS

Exemplary embodiments of the present disclosure will be described in detail based on the following figures, wherein.

DETAILED DESCRIPTION

Now, an exemplary embodiment of the present disclosure will be described in detail with reference to the drawings.

Figure 1:
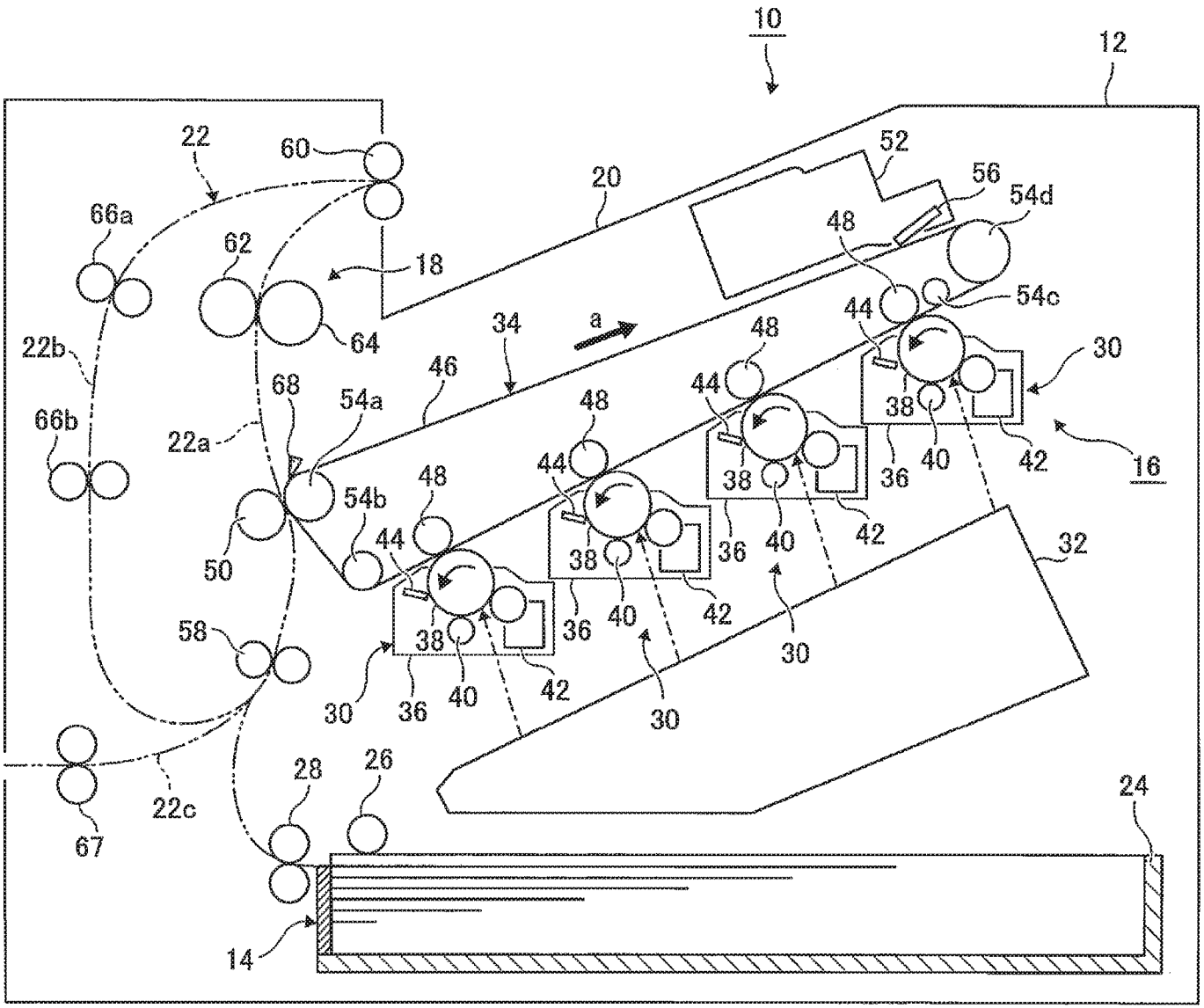
FIG. 1 is a schematic view illustrating an image forming apparatus according to an exemplary embodiment of the present disclosure.
Figure 2:
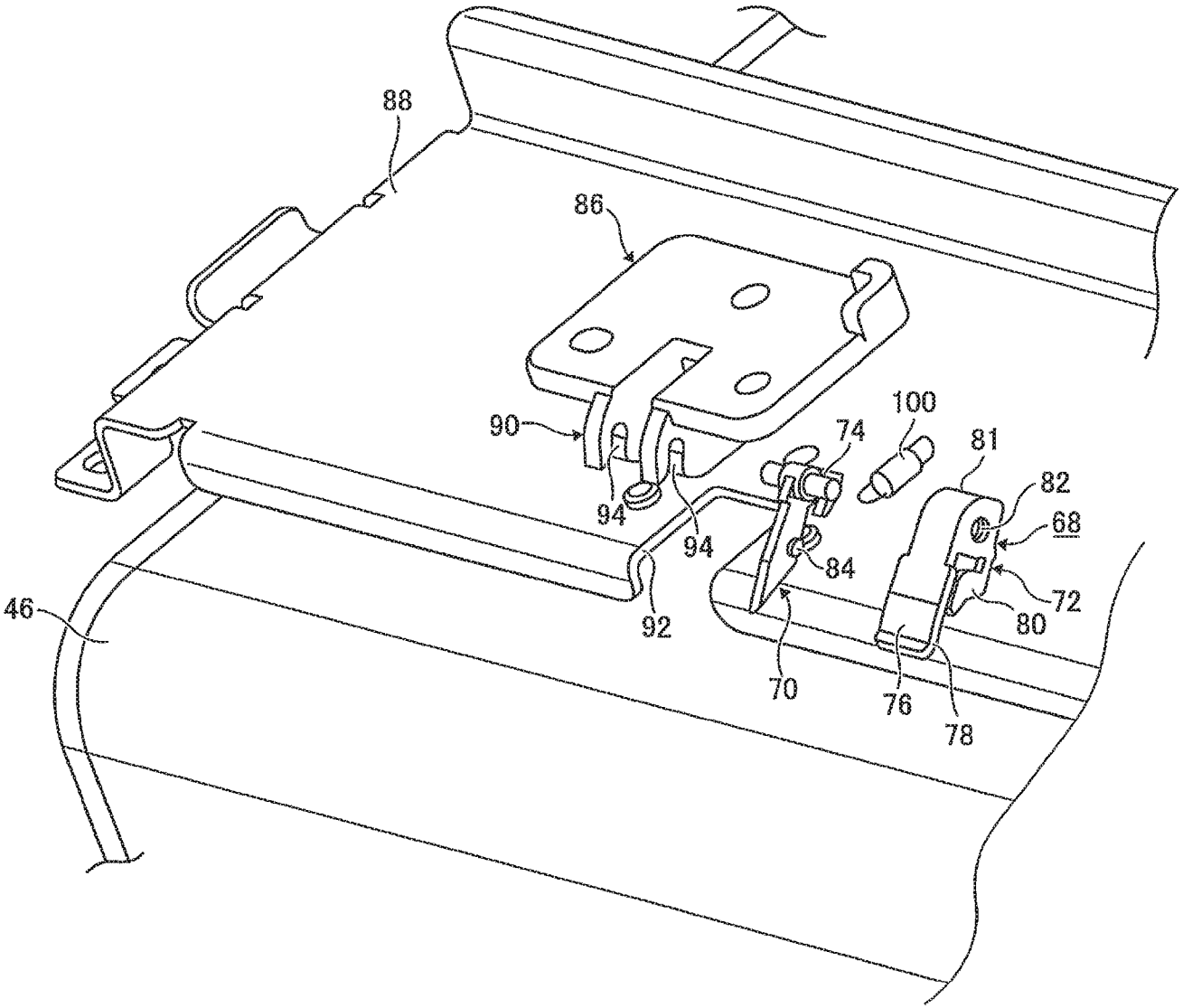
FIG. 2 is an exploded perspective view illustrating a peeling device and surrounding components according to a first exemplary embodiment of the present disclosure.
Figure 3:
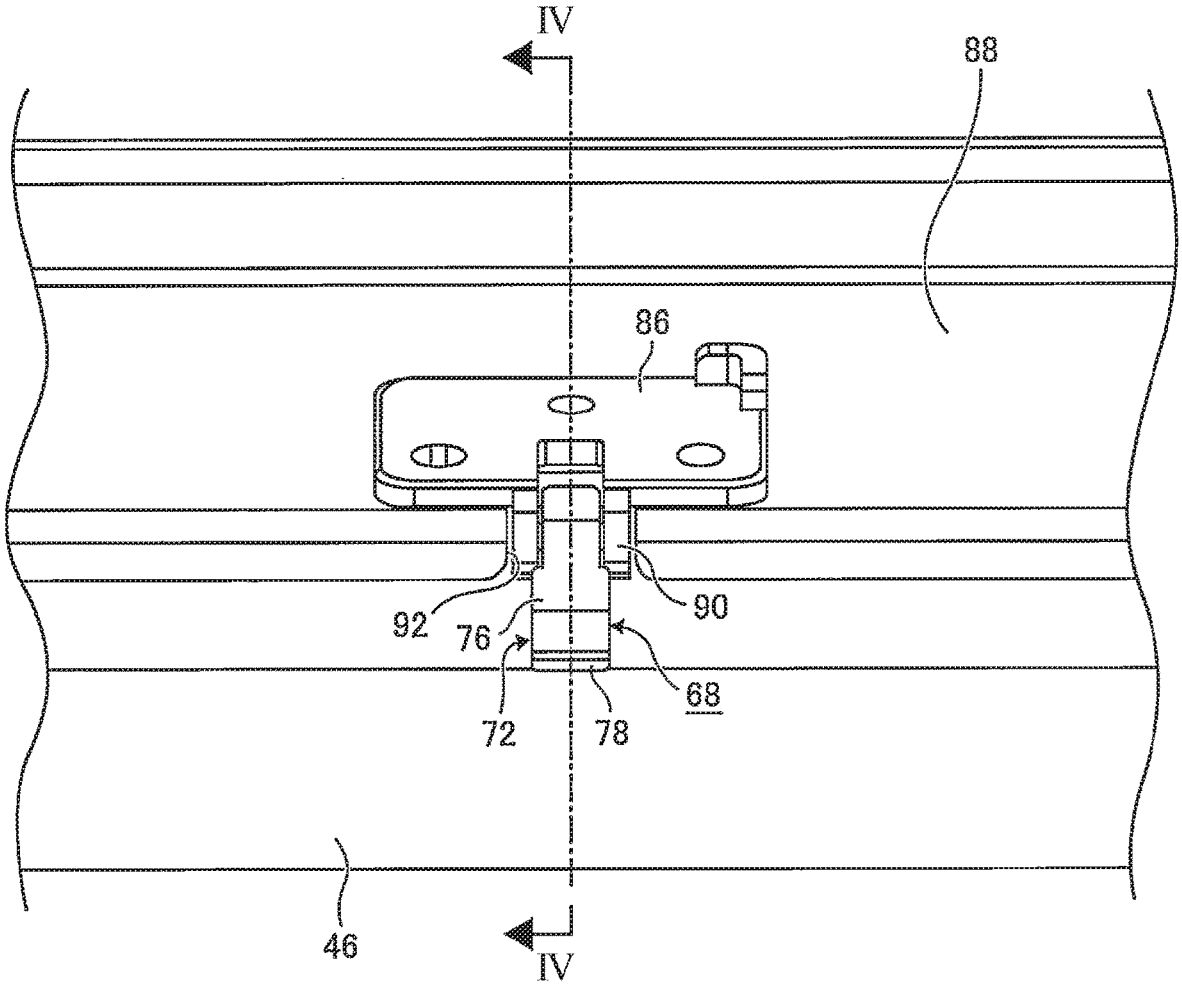
FIG. 3 is a plan view illustrating the peeling device and the surrounding components according to the first exemplary embodiment of the present disclosure.
Figure 4:
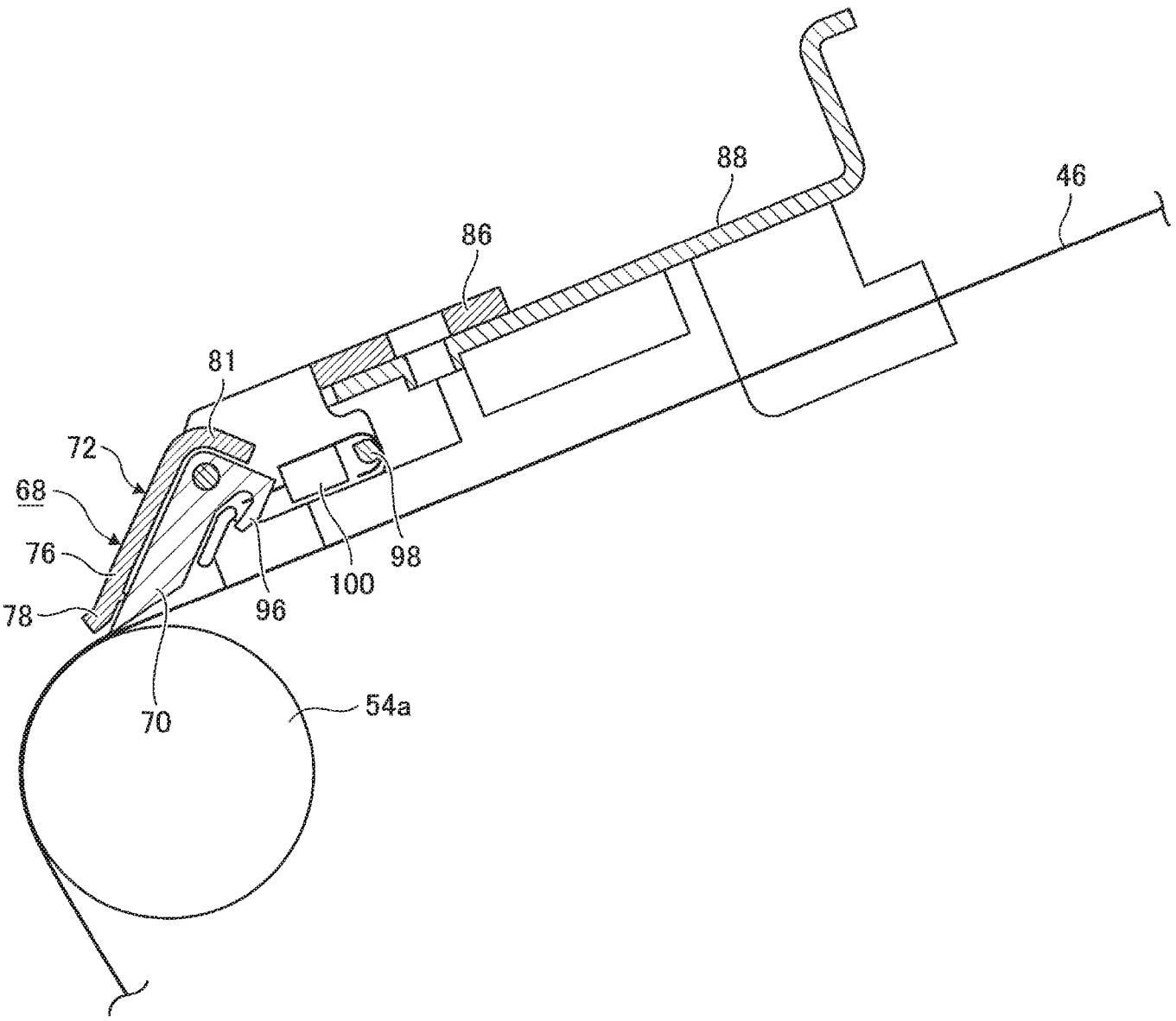
FIG. 4 is a sectional view taken along the line IV-IV in FIG. 3, illustrating the peeling device and the surrounding components according to the first exemplary embodiment of the present disclosure.
Figure 5C:
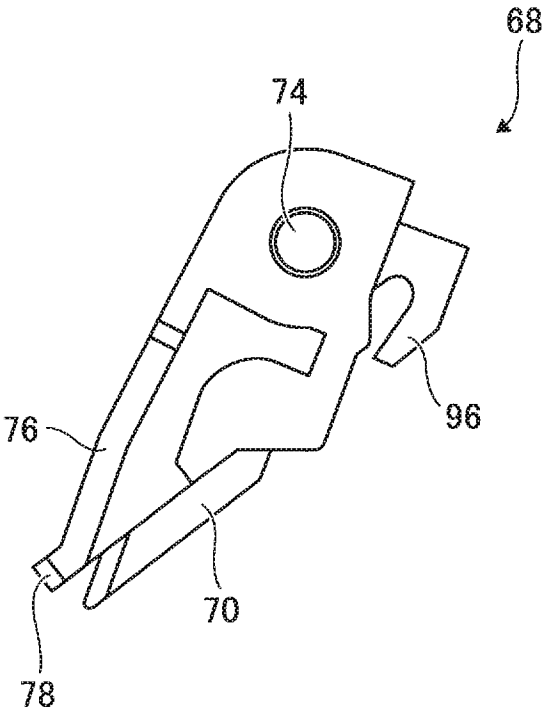
FIGS. 5A, 5B, and 5C are a sectional view, a front view, and a side view, respectively, illustrating the peeling device according to the first exemplary embodiment of the present disclosure.
Figure 5B:
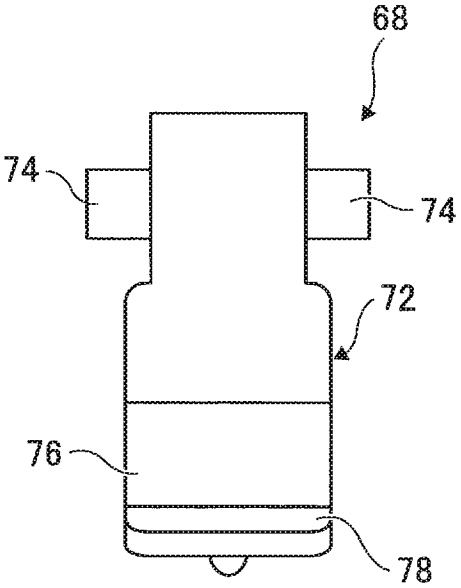
Figure 5A:
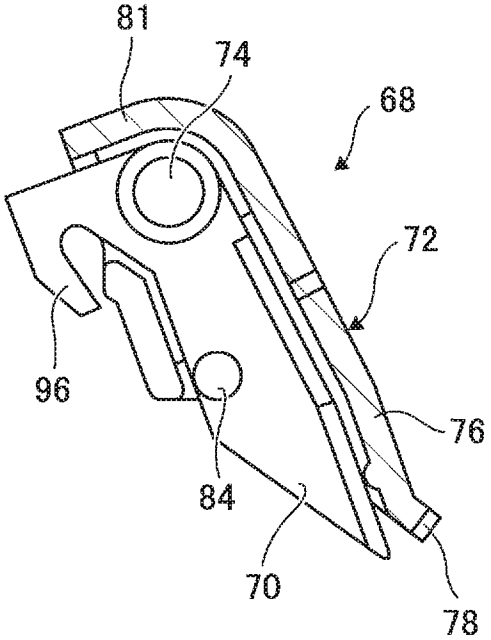

FIG. 1 illustrates an image forming apparatus 10 according to an exemplary embodiment of the present disclosure.

The image forming apparatus 10 includes an image forming apparatus body 10. A paper supply device 14, an image forming section 16, and a fixing device 18 are mounted inside the image forming apparatus body 12. The paper supply device 14 supplies paper as a recording medium. The image forming section 16 forms an image to be transferred to the paper. The image forming apparatus 10 also includes an ejection section 20 and a transport path 22. The ejection section 20 is provided on top of the image forming apparatus body 12. The paper is ejected to the ejection section 20. The transport path 22 transports paper from the paper supply device 14 to the ejection section 20.

The paper supply device 14 includes a paper storage section 24 and a feed roller 26. The paper storage section 24 stores the paper in a stacked state. The feed roller 26 feeds the uppermost piece of the paper stored in the paper storage section 24. The piece of the paper fed by the feed roller 26 is transported to the transport path 22 by a transport roller 28.

The image forming section 16 is composed of image forming units 30, an optical writing device 32, and an intermediate transfer device 34. The image forming sections 16 correspond to four colors, namely yellow (Y), magenta (M), cyan (C), and black (K), for example.

The image forming units 30 are each used as a replaceable member, and removably provided in the image forming apparatus body 12. The image forming units 30 are arranged sequentially in the order of Y, M, C, and K from the rear side (right side in FIG. 1) of the image forming apparatus body 12, for example.

The image forming units 30 are of an electrophotographic system that forms a color image, for example. The image forming units 30 each include a unit body 36. An image holding member 38 in a drum shape, a charging roller 40, a developing device 42, and a cleaning device 44 are provided in the unit body 36. The image holding member 38 holds a developer image. The charging roller 40 uniformly charges the image holding member 38. The developing device 42 develops a latent image written onto the image holding member 38 using a toner. The cleaning device 44 cleans the image holding member 38 by scraping a waste developer that remains on the image holding member 38, for example.

The developing device 42 develops a latent image formed on the corresponding image holding member 38 using a toner in Y, M, C, or K stored in the developing device 42.

The optical writing device 32 is used as a latent image forming device, and constituted of a scanning laser exposure device, for example, that forms a latent image on the surface of each of the image holding members 38. In other exemplary embodiments, light emitting diodes (LEDs), surface emitting lasers, etc. may be used for the optical writing device 32.

The intermediate transfer device 34 includes an intermediate transfer belt 46, first transfer rollers 48, a second transfer roller 50, and a cleaning device 52.

The intermediate transfer belt 46 is in the shape of an endless belt, and is supported by four support rollers 54*a*, 54*b*, 54*c*, and 54*d* so as to be rotatable in the direction indicated by the arrow a in FIG. 1. The support roller 54*a* which is disposed at the leftmost location in FIG. 1, among the support rollers 54*a*, 54*b*, 54*c*, and 54*d*, is coupled to a power source (not illustrated) such as a motor, and rotated upon receiving drive transmitted from the power source to rotationally drive the intermediate transfer belt 34.

The support roller 54*a* is disposed so as to face the second transfer roller 50 with the intermediate transfer belt 46 interposed therebetween, and functions as a back-up member for the second transfer roller 50. A portion interposed between the second transfer roller 50 and the support roller 54*a* is defined as a second transfer position.

The first transfer rollers 48 each transfer a toner image formed on the surface of the image holding member 38 by the corresponding developing device 42 to the intermediate transfer belt 46.

The second transfer roller 50 transfers the toner images in Y, M, C, and K, which have been transferred to the intermediate transfer belt 46, to the paper which has been transported.

The cleaning device 52 includes a scraping member 56 that scrapes toners in the respective colors that remain on the surface of the intermediate transfer belt 46 after developer images in the respective colors are transferred to the paper by the second transfer roller 50. The developer which has been scraped by the scraping member 56 is collected in the body of the cleaning device 50.

The transport path 22 is composed of a principal transport path 22*a*, a reverse transport path 22*b*, and a manual feed transport path 22*c*. The principal transport path 22*a* transports paper supplied from the paper supply device 14 to the image forming section 16, and ejects paper on which an image has been formed to the ejection section 20. The transport roller 28, a registration roller 58, the second transfer roller 50, the fixing device 18, and an ejection roller 60 are disposed in the principal transport path 22*a* sequentially in this order from the upstream side in the paper transport direction.

The registration roller 58 temporarily stops the leading end portion of the paper which is transported from the side of the paper supply device 14, and feeds the paper toward the second transfer roller 50 so as to match the timing to form an image.

The fixing device 18 includes a pressurizing roller 62 and a heating roller 64 that faces the pressurizing roller 62. The toner image which is transferred to the paper is fixed to the paper by heating and pressurizing the paper which passes between the pressurizing roller 62 and the heating roller 64.

The ejection roller 60 ejects the paper, to which the developer has been fixed by the fixing device 18, to the ejection section 20. In addition, the ejection roller 60 is rotated in reverse to invert and lead the paper to the reverse transport path 22*b*. The reverse transport path 22*b* includes two reverse transport rollers 66*a* and 66*b*, for example, and transports the paper to the upstream side of the registration roller 58 using the reverse transport rollers 66*a* and 66*b*. The manual feed transport path 22*c* is provided with a manual feed transport roller 67, and transports paper that is manually fed to the upstream side of the registration roller 58 using the manual feed transport roller 67. Cardboard is supplied from the manual feed transport path 22*c*, for example.

A peeling device 68 is provided on the exit side of the support roller 54*a*. The peeling device 68 peels paper that sticks to the intermediate transfer belt 46 from the intermediate transfer belt 46. In the case where no peeling device 68 is provided, and when thin paper that does not meet the specifications, e.g. paper with a basic weight of 54 g/m$^2$ or less, is transported, the paper may stick onto the intermediate transfer belt 46, and rush into the cleaning device 52 which is provided on the intermediate transfer belt 46 on the downstream side. If the paper rushes into the cleaning device 52, the paper is pressed against the belt surface of the intermediate transfer belt 46, which makes it difficult to extract the paper. Further, when the paper is extracted, the scraping member 56 of the cleaning device 52 may be damaged, and the collected developer may leak from the cleaning device 52 to contaminate the inside of the image forming apparatus body 12.

FIGS. 2 to 6 illustrate the peeling device 68 according to the first exemplary embodiment. The peeling device 68 includes a peeling member 70 and a cover member 72.

A plurality of peeling devices 68 are provided in the short-length direction of the intermediate transfer belt 46.

The peeling member 70 has a pointed leading end on the paper transport side. The leading end of the peeling member 70 contacts the intermediate transfer belt 46. A support shaft 74 is provided on the side of the peeling member 74 opposite to the paper transport side. The support shaft 74 extends toward both sides in a direction (i.e. the short-length direction of the intermediate transfer belt 46) that is orthogonal to the principal transport path 22*a*.

The cover member 72 has a first surface that covers the peeling member 70 on the side of the principal transport path 22. The first surface 76 covers a surface of the peeling member 70 on the side opposite to the intermediate transfer belt 46, including the leading end of the peeling member 70. A bent portion 78 is formed at the leading end of the first surface 76. The bent portion 78 is bent in the paper transport direction. A second surface 80 is formed on both sides of the cover member 72 in the short-length direction of the intermediate transfer belt 46 so as to extend from the first surface 76 toward the intermediate transfer belt 46. A third surface 81 is formed on the rear end side to be continuous with the first surface 76. An insertion hole 82 is formed in the second surface 80. The support shaft 74 of the peeling member 70 is inserted into the insertion hole 82. A regulating portion 84 is formed on the peeling member 70. The regulating portion 84 contacts the second surface 80 of the cover member 72 to regulate the position of the cover member 72 with respect to the peeling member 70 in the counterclockwise direction in FIG. 4.

The peeling device 68 is supported on a support member 86. The support member 86 is fixed to a fixed member 88 by screwing, welding, etc. The fixed member 88 is fixed to the image forming apparatus body 12 at both end portions in the short-length direction of the intermediate transfer belt 46.

A peeling device support portion 90 is formed on the support member 86. The peeling device support portion 90 is inserted into an insertion groove portion 92 formed in the fixed member 88. A support groove portion 94 is formed in the peeling device support portion 90. The support groove portion 94 is formed obliquely toward the intermediate transfer belt 46. The support shaft 74 of the peeling member 70 is inserted into the support groove portion 94.

A first spring receiving portion 96 is formed at the rear end of the peeling member 70. A second spring receiving portion 98 is formed on the back side of the support member 86. A spring 100, which is an elastic member, is provided between the first spring receiving portion 96 and the second spring receiving portion 98. The spring 100 urges the peeling member 70 counterclockwise in FIG. 4. The spring 100 causes the leading end of the peeling member 70 to contact the intermediate transfer belt 46 with a pressure.

Figure 6:
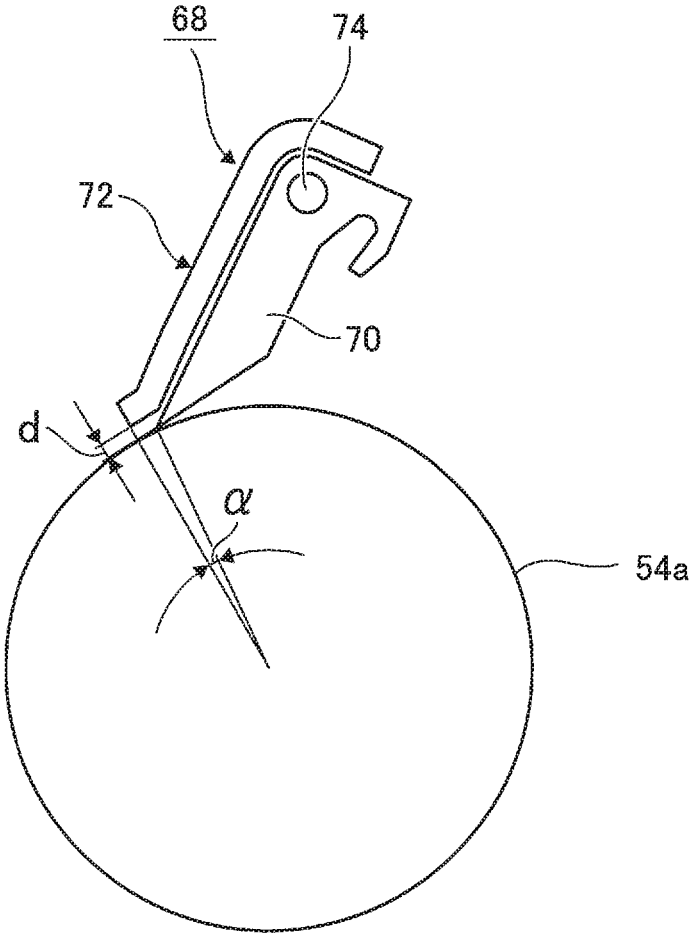
FIG. 6 is a side view illustrating the relationship between the peeling device and a support roller according to the first exemplary embodiment of the present disclosure.

The peeling member 70 and the cover member 72 are supported via the same support shaft 74. As illustrated in FIG. 6, the leading end of the cover member 72 projects toward the paper transport side with respect to the leading end of the peeling member 70 by an angle $\alpha$ about the support roller 54*a*. The angle $\alpha$ may be 0 or more. If the amount of projection of the leading end of the cover member 72 is so large, the developer at the rear end of the paper may adhere to the projecting portion as discussed later. Thus, the amount of projection is preferably small. A distance d between the peeling member 70 and the leading end of the bottom surface of the cover member 72 is set to be small enough to catch the leading end of the paper. Since the peeling member 70 and the cover member 72 are supported on the same support shaft 74, the intersection of the leading end of the cover member 72 with the peeling member 70 may be small.

Next, the function of the peeling device 68 according to the first exemplary embodiment will be described.

FIGS. 7A to 7D illustrate a paper transport state for a case where thin paper that meets the specifications and that has a basis weight of about 64 to 105 g/m$^2$, for example, is transported.

Reference numeral 112 denotes a principal guide portion provided in the principal transport path 22*a* to guide the paper. Reference numeral 114 denotes an exit-side guide portion provided on the side of the exit of the second transfer roller 50 to guide the paper.

Figure 7A:
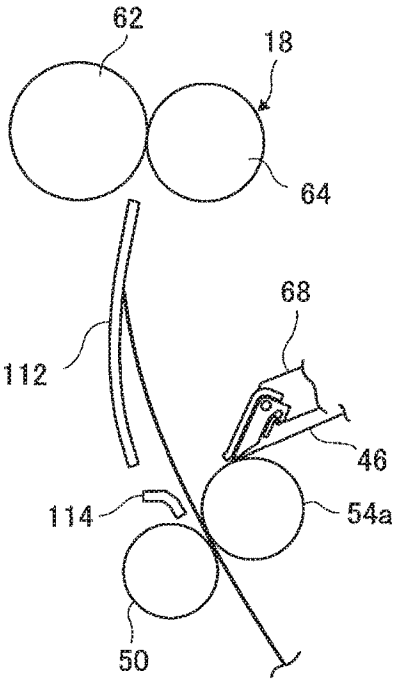
FIGS. 7A to 7D are each a transition view illustrating a transition in the paper transport state for a case where thin paper that meets the specifications is transported in the first exemplary embodiment of the present disclosure.

First, as illustrated in FIG. 7A, when the paper passes between the intermediate transfer belt 46 and the second transfer roller 50 and a developer is transferred to the paper, the leading end of the paper contacts the guide portion 112, and the paper is guided to the fixing device 18.

Figure 7B:
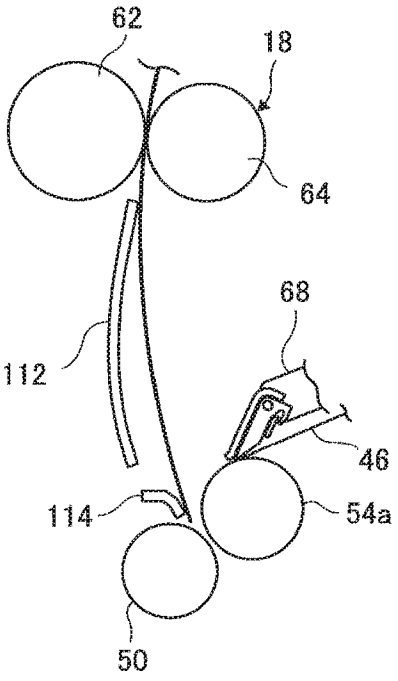

Next, as illustrated in FIG. 7B, the leading end of the paper reaches the fixing device 18, and the rear end of the paper exits from a portion interposed between the intermediate transfer belt 46 and the second transfer roller 50.

Figure 7C:
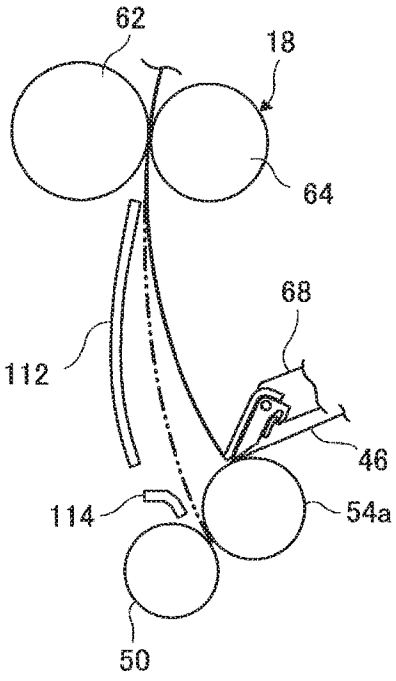

Next, as illustrated in FIG. 7C, the rear end of the paper is occasionally tilted toward the peeling device 68 to contact the leading end of the cover member 72 of the peeling device 68. Since the developer does not adhere to the first surface 76 of the cover member 72, the developer is not scattered when the rear end of the paper contacts the cover member 72. When the rear end of the paper contacts the cover member 72, the cover member 72 and the peeling member 70 are vibrated by an impact caused when the paper contacts the cover member 72. A developer from the paper peeled previously adheres to the leading end of the peeling member 70, and the developer adhering to the peeling member 70 is scattered as a cloud when the peeling member 70 is vibrated. However, the upper surface of the peeling member 70 is surrounded by the first surface 76, the second surface 80, and the third surface 81 of the cover member 72, and the developer scattered from the peeling member 70 is received particularly by the back side of the first surface 76.

Figure 7D:
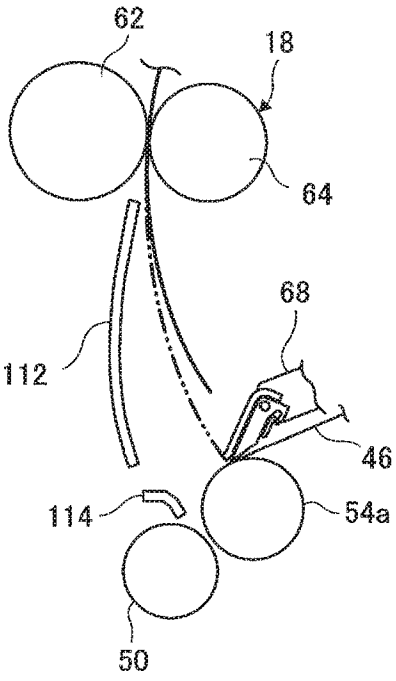

Next, as illustrated in FIG. 7D, the rear end of the paper is released from the leading end of the cover member 72, and moved toward the fixing device 18.

FIGS. 8A to 8D illustrate a paper transport state for a case where thin paper that does not meet the specifications, e.g. paper with a basis weight of 54 g/m$^2$ or less, is transported.

Figure 8A:
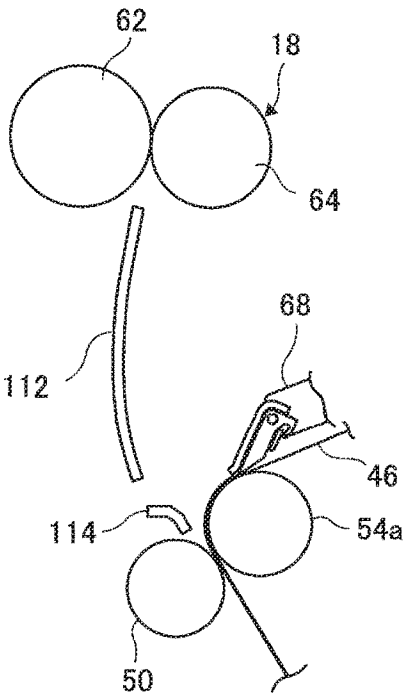
FIGS. 8A to 8D are each a transition view illustrating a transition in the paper transport state for a case where thin paper that does not meet the specifications is transported in the first exemplary embodiment of the present disclosure.

First, as illustrated in FIG. 8A, when the leading end of the paper exits from a portion interposed between the intermediate transfer belt 46 and the second transfer roller 50, the leading end of the paper sticks to the intermediate transfer belt 46 with the adherence of the intermediate transfer belt 46 exceeding the low firmness of the paper.

Figure 8B:
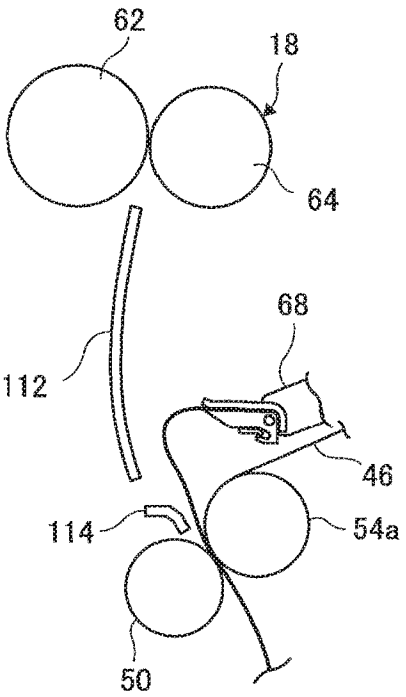

Next, as illustrated in FIG. 8B, when the leading end of the paper sticks to the intermediate transfer belt 46, the leading end of the paper contacts the leading end of the peeling member 70. The peeling member 70 suppresses intrusion of the paper, and guides the leading end of the paper to the lower surface of the bent portion 78 of the cover member 72. When the leading end of the paper contacts the lower surface of the bent portion 78 of the cover member 72, the cover member 72 is rotated clockwise. When the cover member 72 is rotated, the peeling member 70 is also rotated clockwise along with rotation of the cover member 72.

Figure 8C:
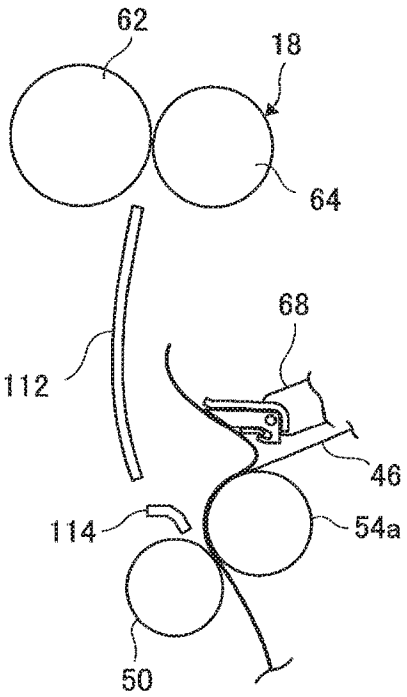

Next, as illustrated in FIG. 8C, the leading end of the paper exits from the bent portion 78. Since the bent portion 78 is bent in the paper transport direction, the leading end of the paper easily exits from the bent portion 78. Even when the leading end of the paper exits from the bent portion 78, a portion of the paper behind the leading end is bent toward the peeling member 72.

Figure 8D:
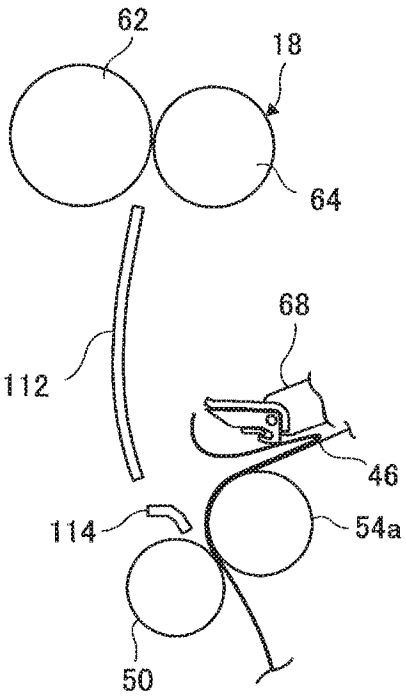

Next, as illustrated in FIG. 8D, when the paper is further transported with the portion of the paper behind the leading end bent toward the peeling member 72, the bent portion of the paper is caught between the peeling member 72 and the intermediate transfer belt 46. A paper jam is detected in this state.

Figure 9:
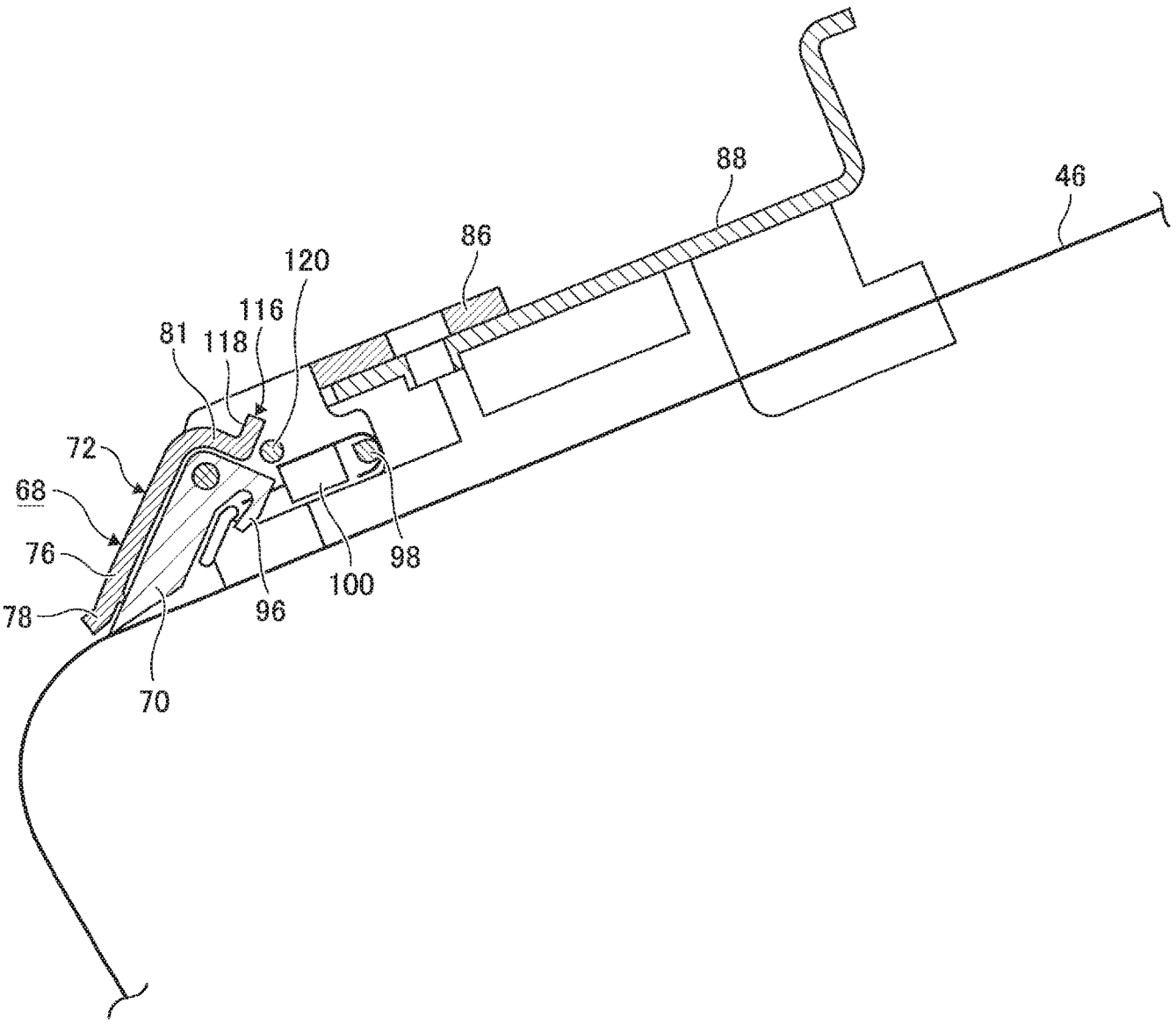
FIG. 9 is a sectional view illustrating a peeling device according to a second exemplary embodiment of the present disclosure.

FIG. 9 illustrates a peeling device 68 according to a second exemplary embodiment.

The second exemplary embodiment differs from the first exemplary embodiment in that a restriction unit 116 that restricts rotation of the cover member 72 in the clockwise direction in FIG. 9 is provided.

That is, the restriction unit 116 is composed of a restriction protrusion 118 that projects rearward from the lower portion of the third surface 81 of the cover member 72, and a restriction shaft portion 120 formed on the support member 86 in correspondence with the restriction protrusion 118. When the cover member 72 is rotated clockwise, the restriction protrusion 118 of the cover member 72 contacts the restriction shaft portion 120 of the support member 86, and movement of the leading end portion of the cover member 72 is restricted to a distance determined in advance in the paper transport direction. The restriction protrusion 118 of the cover member 72 covers the rear side of the peeling member 70.

Next, the function of the peeling device 68 according to the second exemplary embodiment will be described.

FIGS. 10A to 10D illustrate a paper transport state for a case where thin paper that does not meet the specifications, e.g. paper with a basis weight of 54 g/m$^2$ or less, is transported.

Figure 10A:
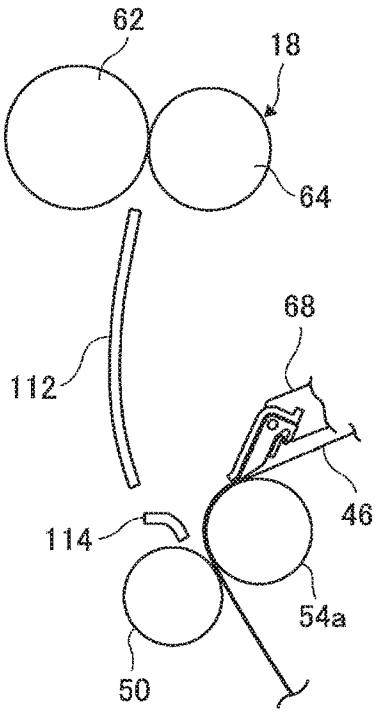
FIGS. 10A to 10D are each a transition view illustrating a transition in the paper transport state for a case where thin paper that does not meet the specifications is transported in the second exemplary embodiment of the present disclosure.

First, as illustrated in FIG. 10A, the leading end of the paper sticks to the intermediate transfer belt 46, as in the first exemplary embodiment.

Figure 10B:
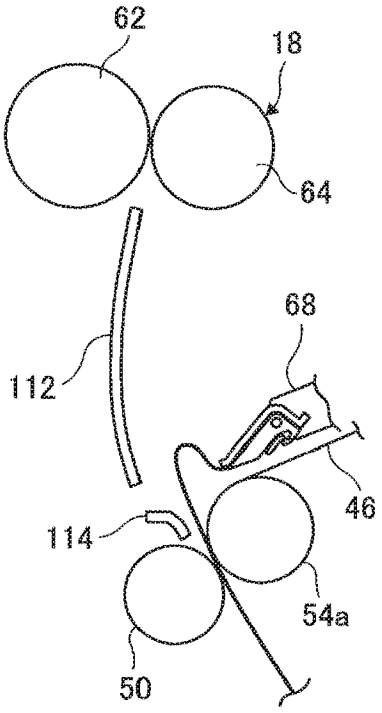
Figure 10C:
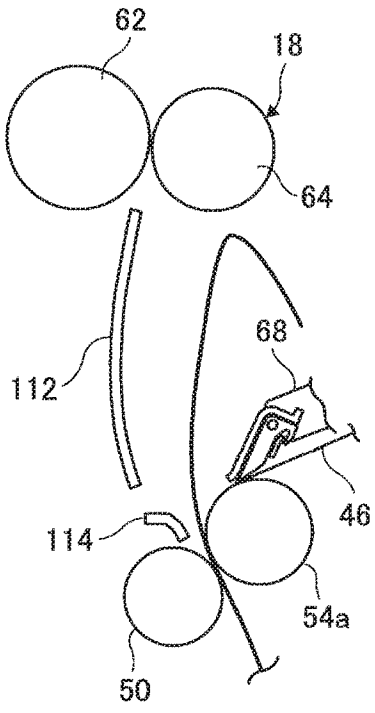
Figure 10D:
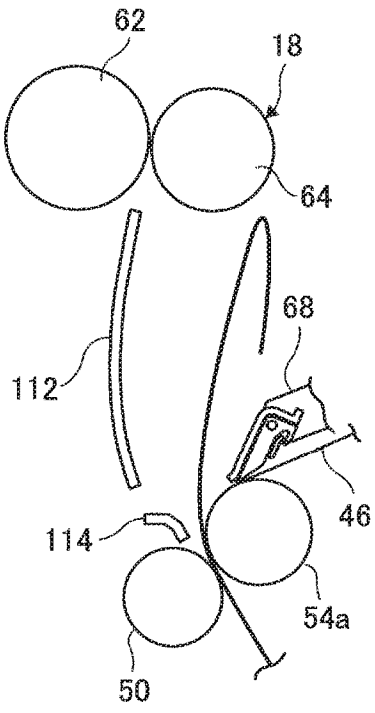

Next, as illustrated in FIG. 10B, the leading end of the paper contacts the lower surface of the bent portion 78 of the cover member 72 to rotate the cover member 72 clockwise. Since clockwise rotation of the cover member 72 is restricted by the restriction unit 116, however, a bent portion of the paper does not intrude between the peeling member 70 and the intermediate transfer belt 48, unlike the first exemplary embodiment, and the paper is transported toward the fixing device 18.

As illustrated in FIG. 10B, the leading end of the paper is bent, and moved out of the principal transport path 22*a*. Thus, the leading end of the paper does not reach a portion interposed between the pressurizing roller 62 and the heating roller 64 of the fixing device 18. A paper jam is detected in the state illustrated in FIG. 10D, and transport of the paper is stopped.

The rear end of the paper occasionally contacts the leading end of the cover member 72 as illustrated in FIG. 7C. When the rear end of the paper contacts the leading end of the cover member 72, the developer at the rear end of the paper may adhere to the cover member 72. When the developer adheres to the rear end of the paper, the developer may be transferred to the next paper to be transported.

Figure 11:
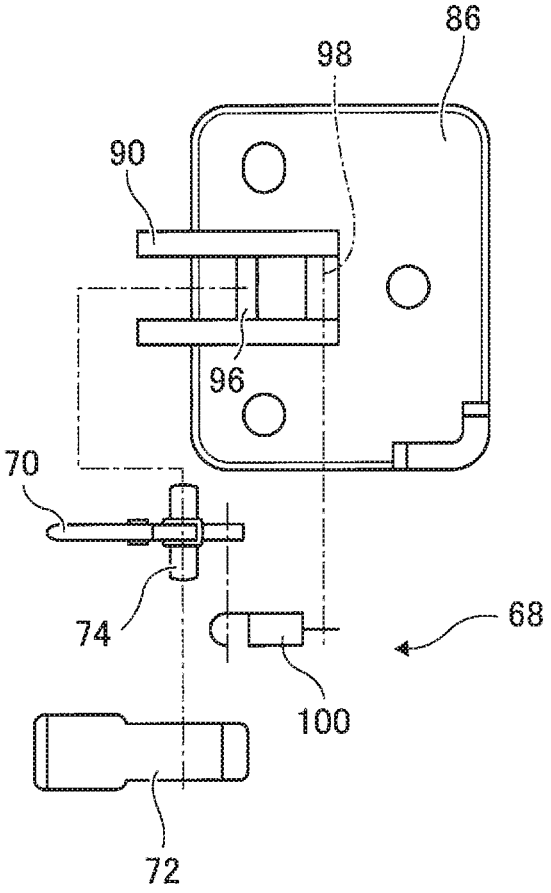
FIG. 11 is an exploded view illustrating the peeling device and a support member according to the second exemplary embodiment of the present disclosure.

In the case where it is desirable to avoid such a phenomenon, the cover member 72 may be removed as illustrated in FIG. 11.

That is, first, the spring 100 is removed. Next, the peeling member 70 and the cover member 72 are removed from the support member 86. Since the support shaft 74 which is formed on the peeling member 70 is merely inserted into the support groove portion 94 of the support member 86, the peeling member 70 and the cover member 72 are removed from the support member 86 by sliding the support shaft 74 with respect to the support groove portion 94. Next, the peeling member 70 and the cover member 72 are separated from each other. Next, only the peeling member 70 is mounted to the support member 86, and the spring 100 is mounted to complete the assembly.

Figure 12:
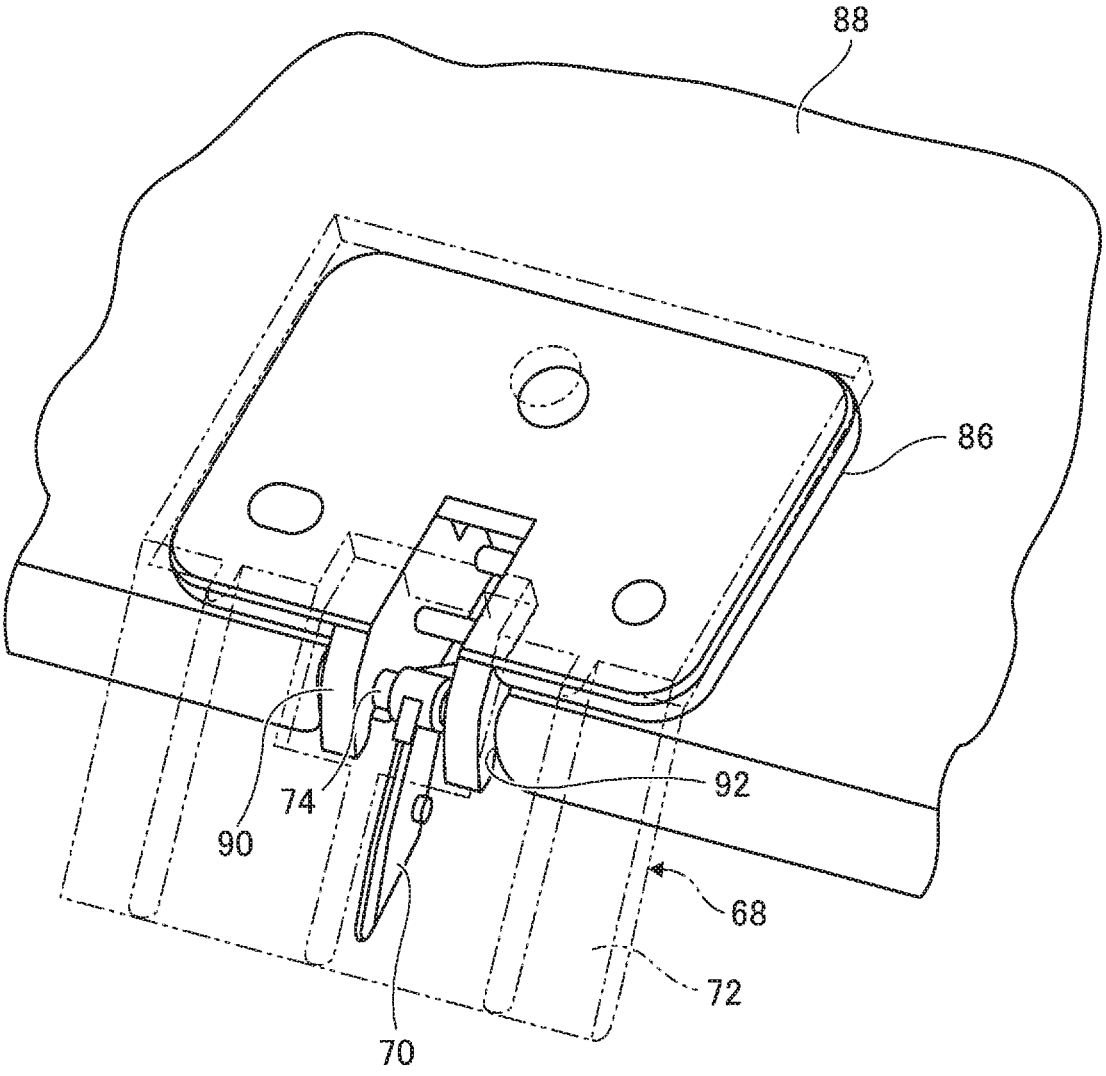
FIG. 12 is a perspective view illustrating a peeling device and surrounding components according to a third exemplary embodiment of the present disclosure.

FIG. 12 illustrates a peeling device 68 according to a third exemplary embodiment. In the first and second exemplary embodiments discussed above, the peeling member 70 and the cover member 72 are supported on the support member 86 via the same support shaft 74. In the third exemplary embodiment, in contrast, the peeling member 70 and the cover member 72 are separately supported on the support member 86. That is, the peeling member 70 is supported on the support member 86 via the support shaft 74, and the cover member 72 is directly fixed to the support member 86. The cover member 72 may be formed integrally with the support member 86. Also in the third exemplary embodiment, the peeling member 70 is covered by the cover member 72 on the paper transport side.

Figure 13:
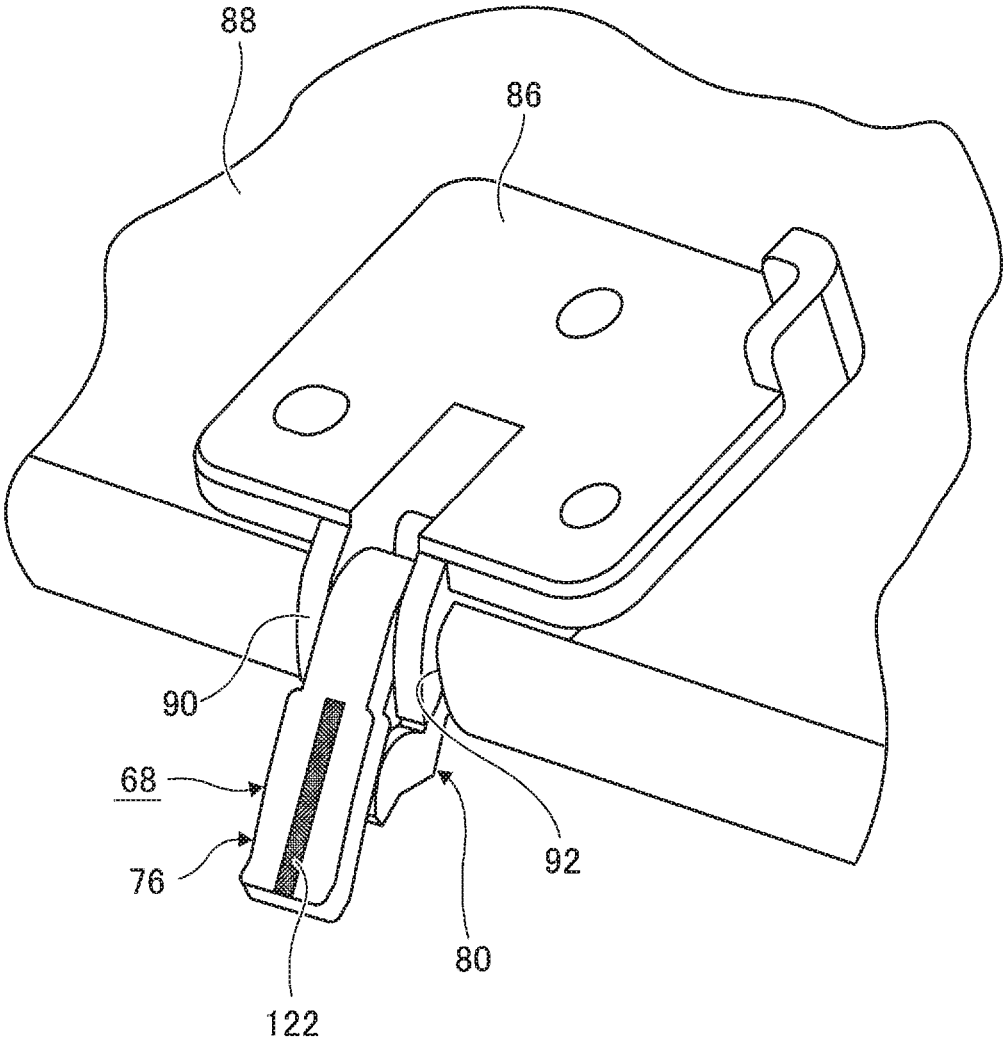
FIG. 13 is a perspective view illustrating a peeling device and surrounding components according to a fourth exemplary embodiment of the present disclosure.

FIG. 13 illustrates a peeling device 68 according to a fourth exemplary embodiment. In the fourth exemplary embodiment, the amount of the developer that adheres to the first surface 76 of the cover member 72 from the paper is reduced.

Figure 14A:
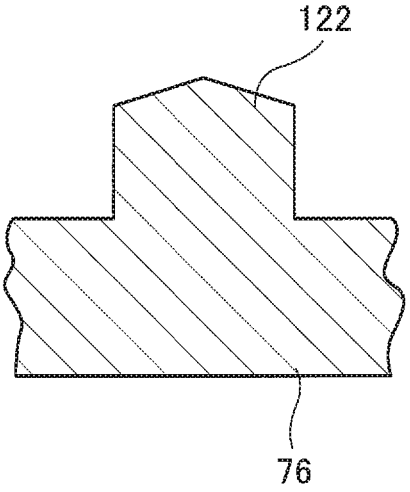
FIGS. 14A and 14B are each a sectional view of a first surface of the peeling device according to the fourth exemplary embodiment of the present disclosure.
Figure 14B:
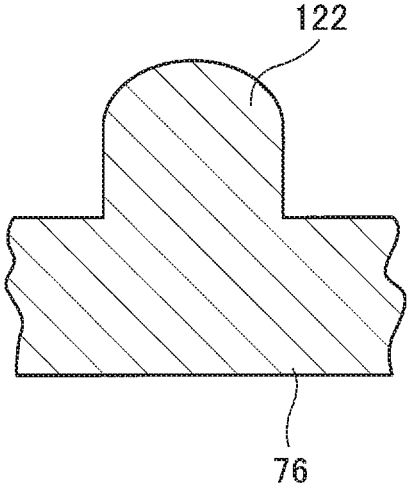

A projecting portion 122, the longitudinal direction of which corresponds to the paper transport direction, is formed at the middle of the first surface 76 of the cover member 72. The projecting portion 122 may have a pointed leading end as illustrated in FIG. 14A, and may be formed in a curved shape as illustrated in FIG. 14B. When the paper contacts the cover member 72, the paper contacts the projecting portion 122 at a point or on a line, which reduces the amount of the developer that adheres to the first surface of the cover member 72 from the paper.

Figure 15:
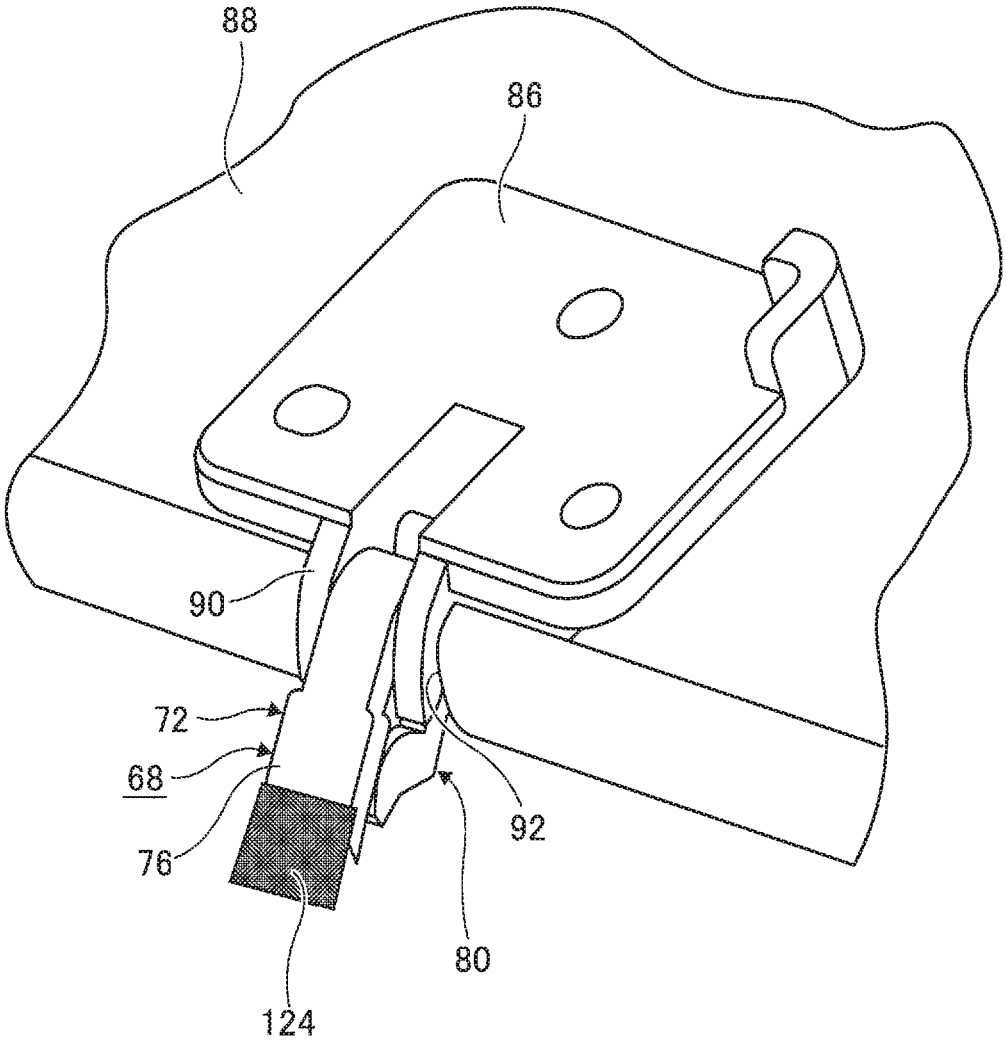
FIG. 15 is a perspective view illustrating a peeling device and surrounding components according to a fifth exemplary embodiment of the present disclosure.

FIG. 15 illustrates a peeling device 68 according to a fifth exemplary embodiment. In the fifth exemplary embodiment, an escape portion 124 is provided in place of the projecting portion 122 which is provided in the fourth exemplary embodiment.

That is, the escape portion 124 is provided at the leading end of the first surface 76 of the cover member 72. The escape portion 122 is constituted from a material that is elastic or flexible such as plastic such as polyethylene terephthalate (PET), rubber, or metal with a thickness of 0.25 mm or less, for example. When the rear end of the paper contacts the escape portion 114, the escape portion 114 escapes toward the side opposite to the paper transport side to relieve the pressure of the contact of the paper.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A peeling device comprising:

a peeling member that peels a recording medium, to which an unfixed developer has been transferred from an image holding member, from the image holding member, a leading end of the peeling member contacting the image holding member;

a cover member that covers a surface of the peeling member with a gap interposed between the peeling member and the cover member, the surface of the peeling member including at least the leading end of the peeling member and including at least a surface of the peeling member on a side not facing the image holding member; and a restriction unit that restricts movement of the cover member toward the downstream side in the transport direction, in which the recording medium is transported, to a distance determined in advance, wherein the cover member is supported so as to be movable toward the downstream side in a transport direction in which the recording medium is transported, wherein the restriction unit includes a restriction protrusion formed to project toward a side opposite to a leading end of the cover member.

2. The peeling device according to claim 1, wherein the cover member is supported separately from the peeling member.

3. The peeling device according to claim 1, wherein the cover member and the peeling member are supported on an identical support shaft.

4. The peeling device according to claim 1, wherein a leading end of the cover member is bent in a transport direction for the recording medium.

5. The peeling device according to claim 1, wherein a leading end of the cover member extends more toward a transport side for the recording medium than the leading end of the peeling member.

6. The image forming apparatus according to claim 1, further comprising a spring member configured to urge the peeling member into to contact with the image holding member.

7. A peeling device comprising:

a peeling member that peels a recording medium, to which an unfixed developer has been transferred from an image holding member, from the image holding member, a leading end of the peeling member contacting the image holding member; and a cover member that covers a surface of the peeling member with a gap interposed between the peeling member and the cover member, the surface of the peeling member including at least the leading end of the peeling member and including at least a surface of the peeling member on a side not facing the image holding member, wherein the cover member includes a projecting portion provided on a surface of the cover member that faces a transport path for the recording medium to project along a transport direction for the recording medium.

8. A peeling device comprising:

a peeling member that peels a recording medium, to which an unfixed developer has been transferred from an image holding member, from the image holding member, a leading end of the peeling member contacting the image holding member; and a cover member that covers a surface of the peeling member with a gap interposed between the peeling member and the cover member, the surface of the peeling member including at least the leading end of the peeling member and including at least a surface of the peeling member on a side not facing the image holding member, wherein a middle portion of the cover member projects more toward a transport path for the recording medium than an end portion of the cover member in a direction that is orthogonal to a transport direction for the recording medium.

9. A peeling device comprising:

a peeling member that peels a recording medium, to which an unfixed developer has been transferred from an image holding member, from the image holding member, a leading end of the peeling member contacting the image holding member; and a cover member that covers a surface of the peeling member with a gap interposed between the peeling member and the cover member, the surface of the peeling member including at least the leading end of the peeling member and including at least a surface of the peeling member on a side not facing the image holding member, wherein the cover member is formed with an escape portion that escapes toward a side opposite to a direction of contact by the recording medium when the escape portion is contacted by the recording medium.

* * * * *